US009080566B2

(12) United States Patent
Christov et al.

(10) Patent No.: US 9,080,566 B2
(45) Date of Patent: Jul. 14, 2015

(54) TWO-SPINDLE SCREW PUMP OF DOUBLE-FLOW CONSTRUCTION

(71) Applicant: Jung & Co. Geratebau GmbH, Kummerfeld (DE)

(72) Inventors: Weshen Christov, Buckeburg (DE); Hans Jung, Pinneberg (DE)

(73) Assignee: Jung and Co. Geratebau, GMBH, Kummerfeld (DE)

( * ) Notice: Subject to any disclaimer, the term of this patent is extended or adjusted under 35 U.S.C. 154(b) by 167 days.

(21) Appl. No.: 13/754,689

(22) Filed: Jan. 30, 2013

(65) Prior Publication Data

US 2013/0202473 A1 Aug. 8, 2013

(51) Int. Cl.

| | |
|---|---|
| ***F01C 11/00*** | (2006.01) |
| ***F04C 2/08*** | (2006.01) |
| ***F01C 21/10*** | (2006.01) |
| ***F04C 2/16*** | (2006.01) |
| ***F04C 15/00*** | (2006.01) |
| *F01C 17/02* | (2006.01) |

(52) U.S. Cl.

CPC . *F04C 2/08* (2013.01); *F01C 21/10* (2013.01); *F04C 2/084* (2013.01); *F04C 2/165* (2013.01); *F04C 15/0034* (2013.01); *F04C 15/0042* (2013.01); *F04C 15/0061* (2013.01); *F01C 17/02* (2013.01); *F04C 2240/601* (2013.01)

(58) Field of Classification Search

CPC .... F04C 2/08; F04C 15/0034; F04C 15/0042; F04C 2/084; F04C 2240/601; F04C 15/0061; F01C 21/10; F01C 17/02

USPC ..... 418/191, 199, 205

See application file for complete search history.

(56) References Cited

U.S. PATENT DOCUMENTS

| | | | | |
|---|---|---|---|---|
| 2,592,476 A * | 4/1952 | Sennet | ..... | 417/201 |
| 3,269,328 A * | 8/1966 | Sennet | ..... | 418/197 |
| 7,234,925 B2 * | 6/2007 | Beaven et al. | ..... | 418/197 |

FOREIGN PATENT DOCUMENTS

DE 4316735 * 1/1996

* cited by examiner

*Primary Examiner* — Hoang Nguyen

(74) *Attorney, Agent, or Firm* — Mark Rodgers

(57) ABSTRACT

The invention relates to a twin screw pump of double-flow design with a pump housing, two bearing portions and at least one gear portion with at least one gear chamber, with feed screws with double-flow flanks arranged on two shafts, the feed screws on the shafts having a root diameter, the shafts being mounted in the bearing portions via bearings, a seal for sealing the bearing portion with respect to the conveying portion, with gearwheels arranged on the shafts in the gear portion, the shafts being rotatably coupled by means of said gearwheels, characterized in that on either side the inner diameter of the seal is greater than, or the same size as, the root diameter of the feed screws, and/or in that on either side the inner diameter of the bearing is greater than, or the same size as, the inner diameter of the seal.

6 Claims, 3 Drawing Sheets

TWO-SPINDLE SCREW PUMP OF DOUBLE-FLOW CONSTRUCTION

Figure 1:
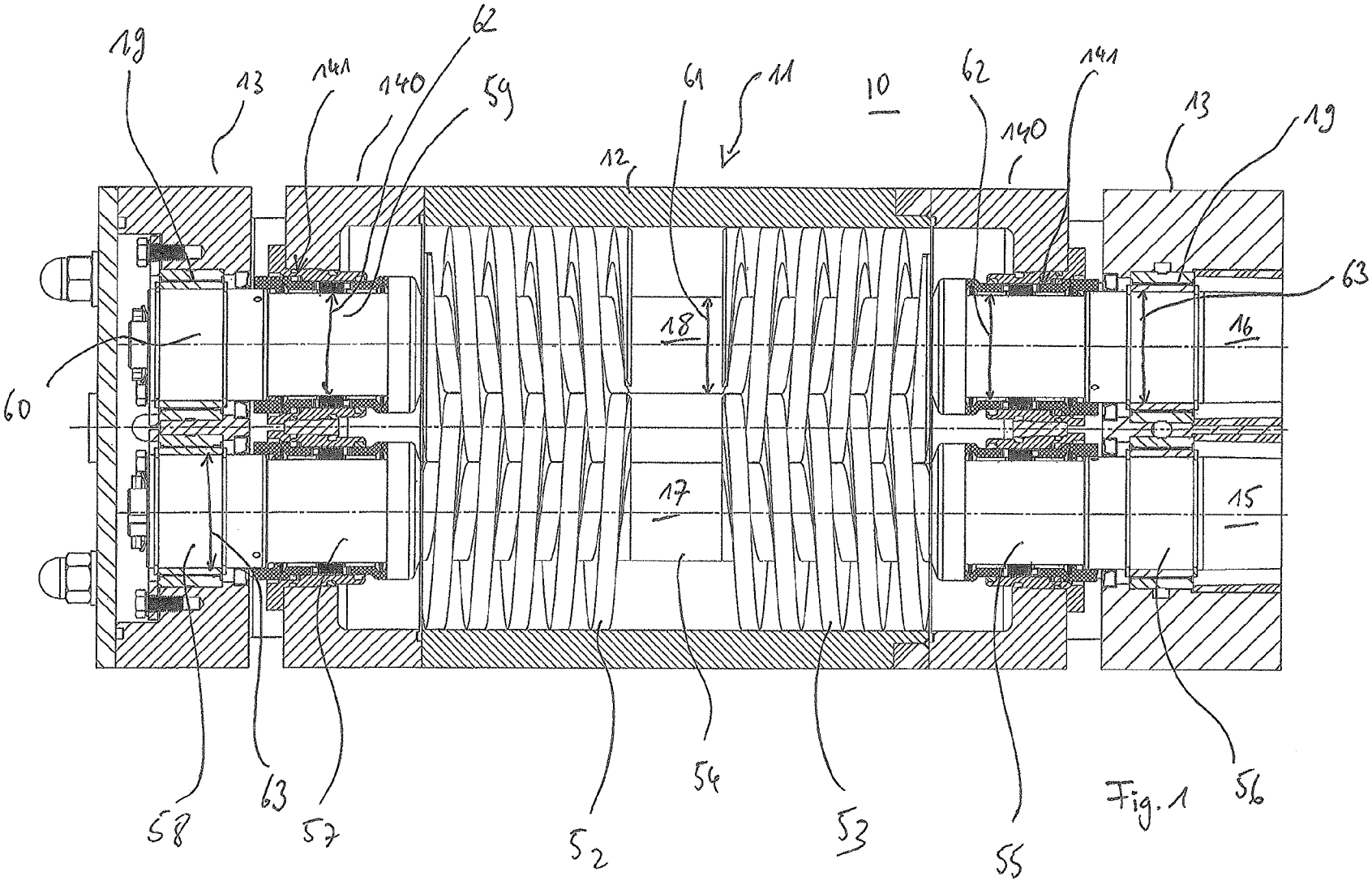

The invention relates to a twin screw pump of double-flow design with a pump housing, which has a pump portion, two bearing portions and at least one gear portion with at least one gear chamber, the bearing portions and the pump portion being formed separately from one another, with a conveyor housing part as a component of the pump portion, in which feed screws with double-flow flanks arranged on two shafts are provided, the feed screws on the shafts having a root diameter, the shafts being mounted on either side in the bearing portions via bearings (external bearing), a seal for sealing the bearing portion with respect to the conveying portion being provided in the bearing portion, and the shafts extending at least on one side into the gear portion, with gearwheels arranged on the shafts in the gear portion, the shafts being rotatably coupled by means of said gearwheels.

Such a pump is known from DE 43 16 735 A1. For manufacturing reasons, such externally mounted double-flow twin screw pumps are structured such that the root diameter of the feed screw is greater than the seal diameter and that this in turn is greater than the inner diameter of the external bearing. Accordingly, the shaft is graduated such that the diameter beneath the external bearings is much smaller than the diameter in the centre of the shaft. The reason for this is that, for assembly of the feed screws and the axial face seals, these have to be slid over the bearing point and this can only be done easily with this structure.

A disadvantage of this structure is that the shaft has a much lower section modulus in the region of the bearing than in the centre of the shaft. This has a detrimental effect on the deflection of the shaft when under load/in operation and limits the permissible pressure difference during use of the pump since contact between the feed screw and the pump housing has to be avoided.

The object of the invention is therefore to improve the construction of the pump so that this limitation is eliminated.

The object according to the invention is achieved in that on either side the inner diameter of the seal is greater than, or the same size as, the root diameter of the feed screws, and/or in that on either side the inner diameter of the bearing is greater than, or the same size as, the inner diameter of the seal. As a result, the shaft has a greater section modulus in the region of the bearing than in the centre, thus reducing/preventing deflection of the shaft under load/in operation.

In accordance with a further teaching of the invention, a first bushing is provided on at least one shaft side, is arranged in the region of the seal, and has an outer diameter that corresponds to the inner diameter of the seal. In accordance with a further teaching of the invention, a bushing is provided on at least one shaft side, is arranged in the region of the bearing, and has an outer diameter that corresponds to the inner diameter of the bearing. As a result of the provision of a bushing, the inner diameter of the seal and of the bearing can be enlarged particularly easily and simple assembly can be ensured at the same time.

In accordance with a further teaching of the invention, the shaft has an outer diameter in the region of the bushing that is smaller than, or the same size as, the root diameter and/or as the inner diameter of the seal. The shafts can thus be installed particularly easily and the result provided by the solution according to the invention can be achieved.

In accordance with a further teaching of the invention, a hydraulic separation is provided between the pump portion and the bearing portion, preferably via an axial face seal, and/or there is a spatial separation between the bearing portion and the gear portion.

In accordance with a further teaching of the invention, the shaft is operatively connected to this arranged fastening element to produce a retentive connection between the shaft and the gearwheel, wherein the fastening element and the gearwheel have corresponding bores, via which a retentive connection can be produced between the gearwheel and the fastening element via a locking element. In this case the bores in the fastening element are preferably formed so that the gearwheel and the fastening element (and therefore the shaft) are rotatable relative to one another, such that a spacing can be adjusted between the flanks of the feed screws (the flank play of the feed screws). It is also advantageous if the fastening element has a bushing portion for sliding onto the shaft, wherein the bushing portion preferably has a receiving portion for the gearwheel, and/or wherein the shaft and the bushing portion have a groove for receiving a feather key to produce a rotationally operative connection between the shaft and the fastening element.

In this case it is also preferable for the bores in the fastening element to be provided as a radial slot, in which the locking element is radially displaceable in the inserted, yet unlocked state, and for the radial length of the slot to be provided such that the end points thereof coincide at least with the contact points between the flanks of the feed screws.

Maintenance and adjustability of the screw pump are improved in this case since it is possible to adjust the entire flank play of the feed screws by means of the provision of the slot. Previously, it was necessary in this instance for the gearwheel to possibly be removed from the shaft and then refitted in a rotated manner so as to adequately adjust the flank play. This adjustment effort is thus reduced considerably.

In accordance with a further teaching of the invention, the fastening element with the slots is only provided on one shaft. This takes into account the fact that it has been found that it is sufficient to adjust merely one shaft, whilst the other shaft remains assembled.

In accordance with a further teaching of the invention, the radial length of the slots is longer than the radial spacing of the contact points of the flanks of the feed screws. It is thus possible to compensate for any one-sided wear of the flanks by corresponding movement beyond the original end points.

In accordance with a further teaching of the invention, an opening is provided in the gear portion of the pump housing, the opening is provided with a removable cover, the opening is arranged such that the cover is removable when the screw pump is assembled, and the gear chamber can be reached in order to adjust the flank play of the feed screws using the tool necessary for this purpose.

Due to the provision of the opening in the housing, it is possible to considerably reduce the time required to readjust the screw because it is no longer necessary to disassemble the gear housing to expose the gear chamber, and it is also not necessary to disassemble the drive module.

Figure 2:
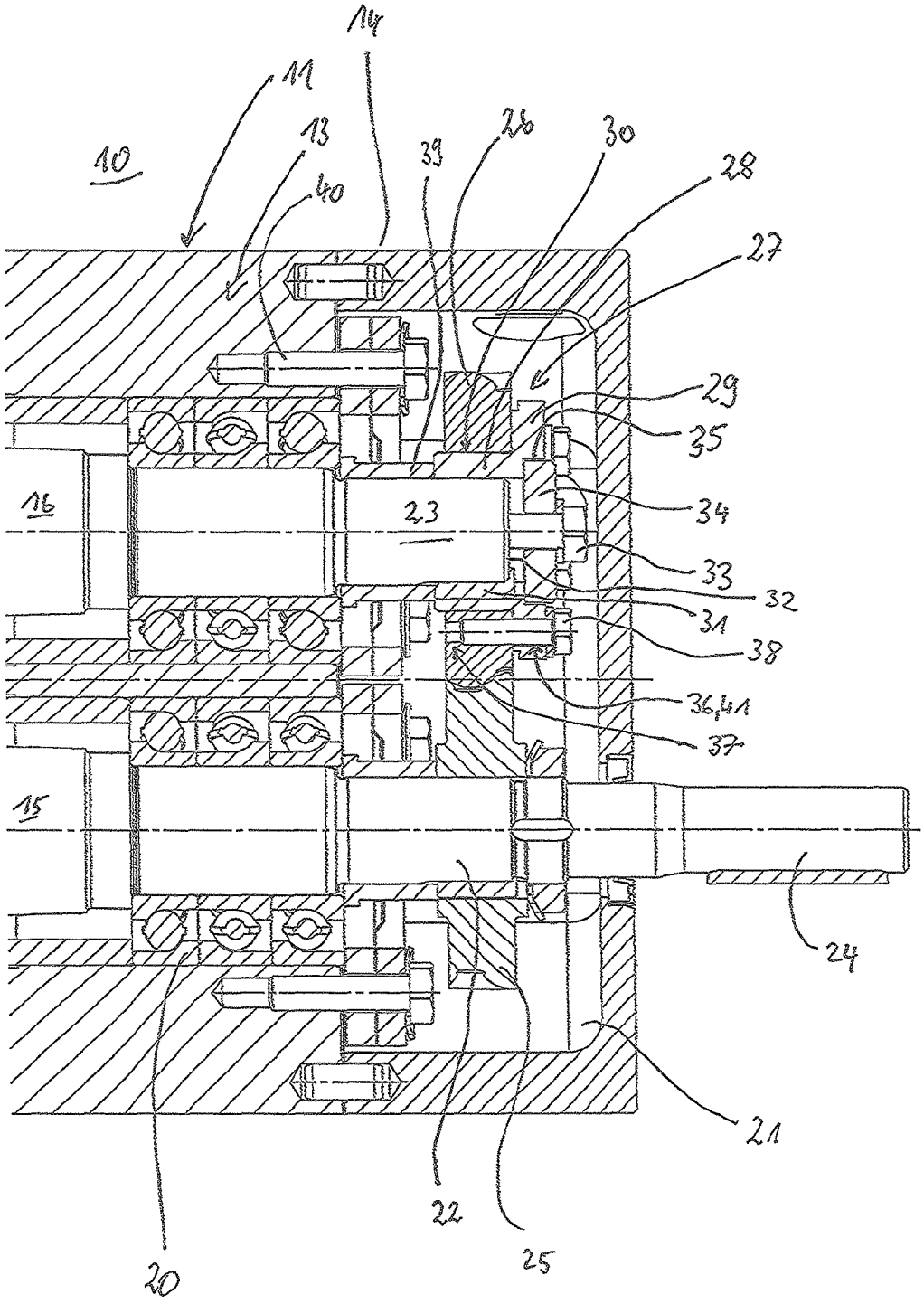
Figure 3:
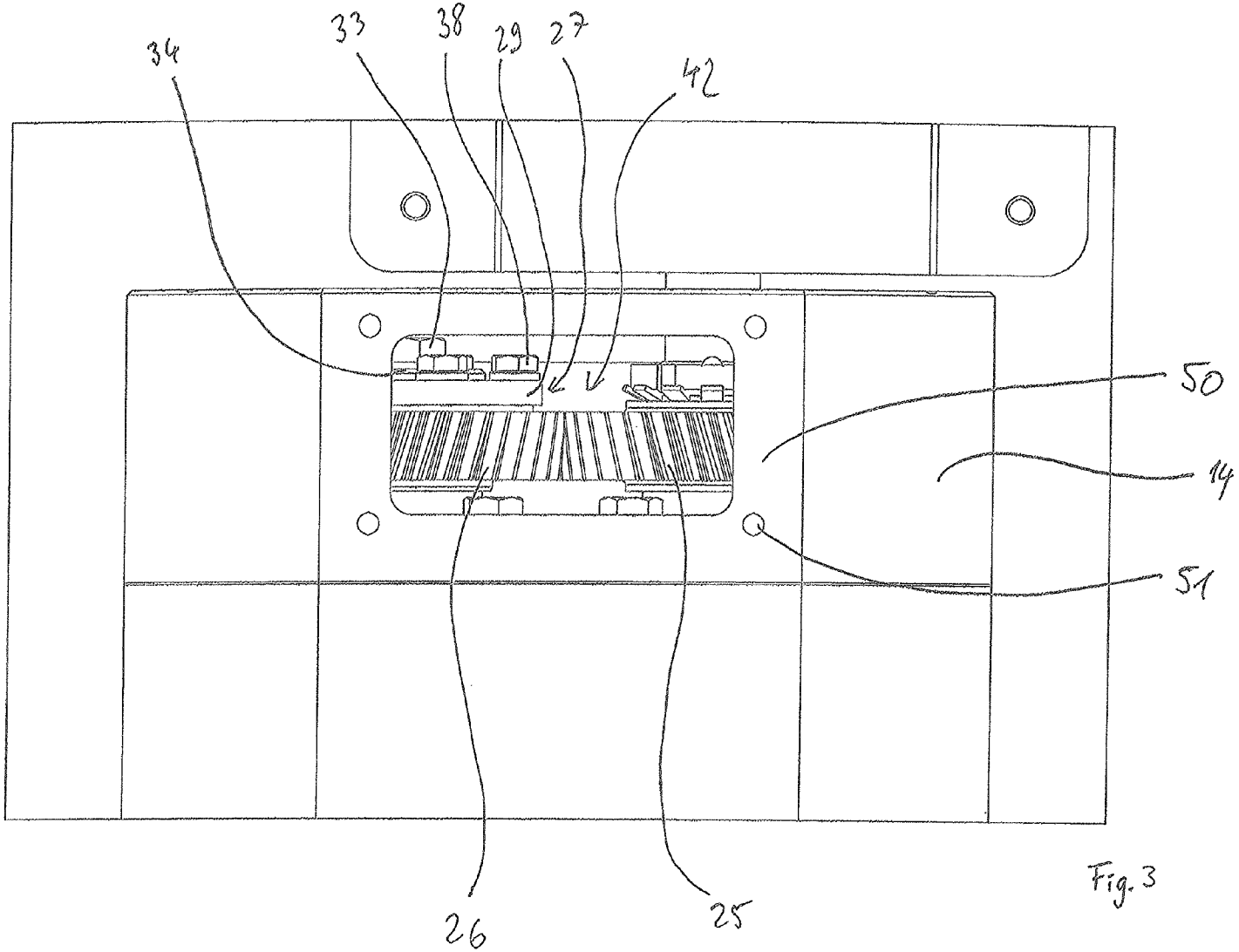

The invention will be explained in greater detail hereinafter on the basis of an exemplary embodiment in conjunction with a drawing, in which:

FIG. 1 shows a sectional view of the pump part of the pump according to the invention, FIG. 2 shows a sectional view of the gear part of the pump according to the invention, and FIG. 3 shows a plan view of the gear portion of FIG. 2.

FIG. 1 shows a sectional view of a screw pump 10 according to the invention. The screw pump 10 has a housing 11, which has a pump portion 12, a bearing portion 13, and a gear portion 14. These are spatially and hydraulically separated from one another via a seal portion 140. The seal portion 140 has an axial face seal 141, which has an inner diameter 62.

Furthermore, the screw pump 10 has a driven shaft 15 and a driven shaft 16. A feed screw 17 is arranged on the driven shaft 15, and a feed screw 18 is arranged on the driven shaft 16. The feed screws 17, 18 each have a first screw portion 52 and a second screw portion 53, which are interconnected via a central part 54. The screw portions 52 and the screw portion 53 are each engaged for conveyance. The root diameter 61 is illustrated in the central part. A needle bearing 19 and a roller bearing 20 are provided in the bearing portion 13 so that the shafts are mounted outside the pump portion 12 in an external bearing. The needle bearing has an inner diameter 63.

In the embodiment according to FIG. 1, the shafts 15, 16 are provided to the right of the second screw portion 53 with a seal portion 55 and a bearing portion 56. These are moulded solidly on the shaft 15, 16. Alternatively, these can also be slid onto the shaft as bushings.

Likewise, a seal portion 57 and a bearing portion 58 are provided on the shafts 15, 16 to the left of the first screw portion 52. These are arranged on the respective shaft 15, 16 as a sealing bushing 59 and as a bearing bushing 60.

The root diameter 61 is smaller than the inner diameter 62 of the axial face seal 141. The inner diameter 63 of the needle bearing 19 is greater than the inner diameter 62 of the axial face seal 141. The outer diameter of the sealing bushing 57 and of the sealing portion 55 in this case correspond substantially to the inner diameter 62 of the axial face seal 141. The outer diameter of the bearing bushing 58 and of the bearing portion 56 in this case correspond substantially to the inner diameter 63 of the needle bearing 19. The shaft is tapered (not illustrated) to receive the bushings 57, 58.

The shaft ends 22, 23 are located in the gear chamber 21 (see FIG. 2). The shaft end 22 of the driven shaft 15 extends out from the housing 11, where it has a connecting piece 24 for a drive unit (not illustrated). A gearwheel 25 is located on the driven shaft 15. A gearwheel 26 is arranged on the other driven shaft. The teeth of the gearwheel 25, 26 are engaged in an intercombing manner.

A fastening element 27 is arranged on the driven shaft 16 on the shaft end 23 (see FIG. 2). The fastening element 27 has a bushing portion 28 and a flange portion 29. The outer side of the bushing portion 28 is simultaneously a receiving face 30 for the gearwheel 26. A feather key 31, via which a rotationally operative connection between the shaft 16 and the fastening element 27 is produced, is inserted into a groove (not illustrated) in the shaft end 23 and in the fastening element 27. A hexagon screw 33, with which a conical spring washer 34 is fastened against a seat 35 in the fastening element 27, is screwed into a bore (not illustrated) in the end face 32 of the shaft end 23. The fastening element 27 is thus connected to the shaft end 23 in a locking manner. The flange portion 29 has a bore 36. The gearwheel 26 has a corresponding bore 37, which can be formed as a through-bore or as a borehole. A thread (not illustrated) is arranged in the bore 37. A hexagon screw 38 is screwed into this thread, whereby the flange portion 29 of the fastening element 27 is locked with the gearwheel 26. A spacer bushing 39, which ensures that the gearwheel 26 cannot come into contact with the fastening screws 40 of the gear portion 14 with the bearing portion 13, is located behind the bushing portion 28 of the fastening element 27.

A plan view of the gear portion 14 without an assembled cover (not illustrated) over the opening 42 is illustrated in FIG. 3. The gear portion 14 in this case has a planar portion 50, in which bores 51 are arranged around the opening 42, which have a thread (not illustrated), into which the fastening screws (not illustrated) are screwed.

If it is necessary to readjust the flank play, as a result of maintenance works on the axial face seals for example, due to wear, or because the feed screws 17, 18 are being replaced, it is possible to access the gear chamber 21 through the opening 42 with a tool (not illustrated) by removing the cover (not illustrated). For example, it is possible to loosen the hexagon screws 38 so as to rotate the driven shaft 16 relative to the gearwheel 26 and therefore readjust the flank play. Once the flank play has been adjusted, the hexagon screws 38 are then tightened again and the cover 43 is made operational again on the planar portion 50 with the fastening screws by introducing the fastening screws into the bore 51.

It is therefore no longer necessary to remove the drive units 49 and/or the gear portion 14 of the housing 11. As a result of the slots 41, it is also no longer necessary to remove the gearwheel 26 from the shaft 16, which is a complex process, in order to then adjust the flank play in a complex manner by turning the gearwheel 26 accordingly over a segment of a circle until the next bore 36 is aligned, and then fitting the gearwheel 26 back onto the shaft 16.

List of Reference Signs:

| | |
|---|---|
| 10 | screw pump |
| 11 | housing |
| 12 | pump portion |
| 13 | bearing portion |
| 14 | gear portion |
| 15 | driven shaft |
| 16 | driven shaft |
| 17 | feed screw |
| 18 | feed screw |
| 19 | needle bearing |
| 20 | roller bearing |
| 21 | gear chamber |
| 22 | shaft end |
| 23 | shaft end |
| 24 | connecting piece |
| 25 | gearwheel |
| 26 | gearwheel |
| 27 | fastening element |
| 28 | bushing portion |
| 29 | flange portion |
| 30 | receiving face |
| 31 | feather key |
| 32 | end face |
| 33 | hexagon screw |
| 34 | conical spring washer |
| 35 | seat |
| 36 | bore |
| 37 | bore |
| 38 | hexagon screw |
| 39 | spacer bushing |
| 40 | fastening screw |
| 41 | slot |
| 42 | opening |
| 45 | screw protrusion |
| 43 | planar portion |
| 51 | bore |
| 52 | first screw portion |
| 53 | second screw portion |
| 54 | central part |
| 55 | sealing portion |
| 56 | bearing portion |
| 57 | sealing portion |
| 58 | bearing portion |
| 59 | sealing bushing |
| 60 | bearing bushing |
| 61 | root diameter |
| 62 | seal inner diameter |
| 63 | bearing inner diameter |

-continued

| List of Reference Signs: | |
|---|---|
| 140 | sealing portion |
| 141 | axial face seal |

The invention claimed is:

1. Twin screw pump of double-flow design with a pump housing, which has a pump portion, two bearing portions and at least one gear portion with at least one gear chamber, the bearing portions and the pump portion being formed separately from one another, with a conveyor housing part as a component of the pump portion, in which feed screws with double-flow flanks arranged on two shafts are provided, the feed screws on the shafts having a root diameter, the shafts being mounted in the bearing portions via bearings, including external bearings, on each side, a seal for sealing the bearing portions with respect to the conveying portion being provided in the bearing portions, and the shafts extending into the gear portion, with gearwheels arranged on the shafts in the gear portion, the shafts being rotatably coupled by means of said gearwheels, characterized in that on both sides the inner diameter of the seal is greater than, or the same size as, the root diameter of the feed screws, and in that on both sides the inner diameter of the bearing is greater than, or the same size as, the inner diameter of the seal.

2. Screw pump according to claim 1, characterized in that a bushing is provided on both shaft sides, is arranged in the region of the bearing, and has an outer diameter that corresponds to the inner diameter of the bearing.

3. Screw pump according to claim 1, characterized in that the shaft has an outer diameter in the region of the bushing that is smaller than, or the same size as, the root diameter or as the inner diameter of the seal.

4. Screw pump according to claim 1, characterized in that there is a hydraulic separation between the pump portion and the bearing portion, via an axial face seal.

5. Screw pump according to claim 4, characterized in that there is a hydraulic separation between the pump portion and the bearing portion via an axial face seal.

6. Screw pump according to claim 1, characterized in that there is a spatial separation between the bearing portion and the gear portion.

* * * * *